United States Patent [19]

Schippers

[11] Patent Number: 4,902,461

[45] Date of Patent: Feb. 20, 1990

[54] METHOD FOR HEATING AN ADVANCING YARN

[75] Inventor: Heinz Schippers, Remscheid, Fed. Rep. of Germany

[73] Assignee: Barmag, AG, Remscheid, Fed. Rep. of Germany

[21] Appl. No.: 169,311

[22] Filed: Mar. 17, 1988

[30] Foreign Application Priority Data

| | | | |
|---|---|---|---|
| Mar. 20, 1987 | [DE] | Fed. Rep. of Germany | 3709233 |
| May 19, 1987 | [DE] | Fed. Rep. of Germany | 3716650 |
| Jun. 19, 1987 | [DE] | Fed. Rep. of Germany | 3720337 |
| Jul. 21, 1987 | [DE] | Fed. Rep. of Germany | 3724095 |

[51] Int. Cl.[4] ..... D01D 5/088; D01D 10/02

[52] U.S. Cl. ..... 264/103; 264/210.8; 264/211.15

[58] Field of Search ..... 264/290.5, 290.7, 210.5, 264/210.8, 103, 235, 235.6, 346, 146, 345, 234, 211.15; 34/18, 41, 152, 234; 28/240

[56] References Cited

U.S. PATENT DOCUMENTS

| | | | |
|---|---|---|---|
| 3,048,467 | 8/1962 | Roberts et al. | 264/290.5 |
| 3,849,529 | 11/1974 | Ferment et al. | 264/290.5 |
| 4,059,668 | 11/1977 | Bittle et al. | 264/290.5 |
| 4,098,864 | 7/1978 | Morris et al. | 264/290.5 |
| 4,497,759 | 2/1985 | Nakagawa et al. | 264/290.5 |

*Primary Examiner*—Hubert C. Lorin

*Attorney, Agent, or Firm*—Bell, Seltzer, Park & Gibson

[57] ABSTRACT

A heating tube is adapted for use in a melt spinning process for producing a highly oriented yarn wherein an elongated heating tube having provision for adjusting the effective heating length in accordance with pre-existing yarn properties and so as to achieve the desired properties in the finished yarn.

11 Claims, 6 Drawing Sheets

METHOD FOR HEATING AN ADVANCING YARN

BACKGROUND OF THE INVENTION

The present invention relates to a method and apparatus for continuously heating an advancing yarn, and more particularly, to a method and apparatus for producing a highly oriented yarn as part of a melt spinning operation.

Yarn heating tubes are conventionally employed in melt spinning operations, wherein a polymeric melt is extruded through a plurality of orifices of a spinning die so as to produce a plurality of filaments, which are then cooled and gathered together to form a yarn composed of a bundle of solidified filaments. The advancing yarn is then heated by passing the yarn through a tubular heating tube.

The dwell time of the yarn in the heating tube is of significance in achieving desired yarn properties, such as strength, elongation behavior, and shrinking behavior. Since the advancing speed is a given, the heating tube must be exchanged for a tube of a different length, in order to vary the dwell time for adapting the system to a yarn of pre-existing properties, such as the polymer of the yarn, the total denier of the yarn, and the denier of the individual filaments.

It is accordingly an object of the present invention to provide a method and apparatus for heating a yarn in a process of the described type, and which avoids the necessity of exchanging the heating tubes to achieve desired yarn characteristics under varying conditions.

It is a more particular object of the present invention to provide a method and apparatus for heating a yarn which is characterized by the ability to vary the dwell time of the yarn in a heating tube at a given yarn speed, and without exchanging the heating tube.

It is a further object of the present invention to provide a method and apparatus of producing a highly oriented yarn as part of a melt spinning operation and which has provision for adjusting the parameters of the process so as to permit the process to be adapted to the pre-existing yarn properties.

SUMMARY OF THE INVENTION

The above and other objects and advantages of the present invention are achieved in the embodiments illustrated herein by the provision of a yarn heating method and apparatus which comprises an elongated heating tube having provision for adjusting the effective heating length of the tube in accordance with the pre-existing yarn properties, and so as to achieve a desired result. In one embodiment, the tube comprises at least two coaxially aligned tube segments, and means are provided for adjustably mounting the tube segments so as to permit axial movement toward and away from each other and so as to change the overall length of the heating tube. Also, means are provided for heating the outer periphery of at least one of the tube segments. By this arrangement, the length of the tube may be changed to thereby vary the dwell time of the yarn in the tube, while the yarn speed remains unchanged, and without the need to exchange the heating tube for a tube of a different length.

In the above embodiment, the ends of the tube segments which are adjacent to each other, may interengage each other by a telescopic interconnection, or they may be interconnected by a flexible coupler, such as a bellows-like coupler.

In another embodiment of the invention, the effective heating length of the heating tube may be varied by providing a heating tube which defines a plurality of partial tube lengths, with means for separately and adjustably heating each of the partial tube lengths.

The heating of the tube may occur in the yarn inlet area and/or the yarn outlet area of the tube, with the heating being provided by any of several known heating methods. In one embodiment, the heating is effected by heating sleeves, which are positioned on the sections of the heating tube at the inlet area and/or outlet area respectively.

It is desirable that the heating tube of the present invention be provided with an insulating jacket, which overlies at least the end zones of the two tube segments which are adjacent to each other, and with the insulating jackets being adjustable in length to accommodate the adjustment of the separation of the tube segments. The insulating jacket may be in the form of a closed box, which is divided into two parts along a line transverse to the tube axis, with the jackets each including an insulating lining. The walls of the two parts of the box may overlap to form a telescopic relationship, and so that the two parts are displacable as they move toward and away from each other. Alaternatively, the two box parts may be interconnected by a flexible connector or a bellows-like coupler. The interior of the insulating jacket may also be heated, such as by introducing a heated gas or hot air.

In another embodiment of the heating tube according to the present invention, a unitary guide tube is inserted into the bore of the heating tube. Preferably, the guide tube consists of a metal or other similar material, which provides for a low frictional engagement with the yarn and which may be easily slid into the heating tube. Also, the guide tube should be resistant to the applied temperatures, and preferably it should be sufficiently thin so that it can be readily cut to a required length.

In still another embodiment, the effective heating length of the heating tube is achieved in that the heat transfer from the heater to the yarn is selectively interrupted. For this purpose, it is proposed that a heat insulation sleeve be positioned either outside or inside of the heating tube, with the sleeve serving to restrict the heat transfer from the heater to the yarn over a predetermined distance, which is shorter than the length of the heating tube. This embodiment is particularly adapted for vapor or fluid heating systems, in which the heating tube is removably inserted into an external support tube which is fixedly connected to the heating system. The heating tube is thus easily exchangeable should it deteriorate from wear and tear. Also, an air gap between the heating tube and the supporting tube which surrounds the heating tube, may be considered as a heat insulating layer, with the air gap extending over a partial length of the heating tube.

A technically equivalent embodiment of the present invention involves having the heating tube subdivided into partial tube lengths, and with the heating system including provision for separately and adjustably heating each of the lengths.

The use of heat deflecting insulating sleeves to change the effective heating length of the heating tube has the advantage of a minimum expenditure. Such insulating sleeves are preferably made of a material with poor heat conducting properties, such as glass.

In one embodiment, the insulating sleeve can be inserted into the heating tube, however in another embodiment, the insulating sleeve may have a sufficiently large inside diameter so that it can be slid coaxially over the heating tube and thereby block the supply of heat to the heating tube. The dwell time of the yarn can thus be varied within a large range, by selecting a particular length of the insulating sleeve. Further, the amount of heat which is radiated to the yarn in the insulated area may be varied by selecting the heat conductivity of the insulating sleeve. According to the invention, several insulating sleeves may be positioned in various places along the length of the heating tube, and preferably at the upper and/or lower ends thereof.

In order to avoid having the insulating sleeve heat up during operation and radiate heat to the heating tube or the yarn, the insulating sleeve may be actively cooled. Such heating of the insulating sleeve which is inserted into the heating tube may also be avoided by providing the insulating sleeve with a yarn guide eyelet which defines a passage of reduced cross sectional diameter for the yarn. The yarn guide eyelet thus provides an area with a smaller diameter than the adjoining areas in the bore of the heating tube, and the yarn guide eyelet acts to strip off the hot air which is entrained with the advancing yarn, since the cross-section of the narrow passage corresponds approximately to the crosssection of the yarn.

To avoid having the air which is heated in the heating tube be entrained by the yarn and carried into an insulating sleeve which is positioned at the outlet end portion of the heating tube, it is preferable to include a yarn guide eyelet at the inlet end of the sleeve.

An insulating sleeve with active cooling may also be achieved by the provision of air gaps between the insulating sleeve and the heating tube. When such air gaps are open toward the ends of the heating tube, an active cooling effect will result, by reason of the resulting circulation of the air.

In order to achieve good insulating properties and good yarn guiding properties, it is also proposed to construct the insulating sleeve of multiple layers. In particular, the insulating sleeve may comprise a layer having a poor heat conductivity together with a layer having good yarn guiding properties.

In accordance with the present invention, there are two possibilities for adjusting the effective insulating lengths in the heating tube. First, the insulating sleeve, which may be made of a relatively light weight and inexpensive material, may be cut to the desired insulating length. In this instance, the insulating sleeve will not project from the ends of the heating tube. Second, the insulating sleeve of a given length may be inserted into the heating tube so as to overlap only a portion of the length of the tube, and until it covers the desired insulating length. In this embodiment, it is advantageous to provide the surface of the insulating sleeve with visible indicia. Thus it is possible in the case of a large number of heating tubes which must be monitored, to easily monitor the positioning of each of the inserted insulating sleeves.

The heating tubes may be designed and constructed so that they are inserted and supported in support tubes. The support tubes are mounted so as to be heated from the outside. In this embodiment, the heating tube is subjected to the wear and tear, and is easily exchangeable. Also, it is suggested for this embodiment that partial lengths of the heating tube be made with a smaller outside diameter than the inside diameter of the bore of the support tube. As a result, heat insulating air gaps are formed between the externally heated support tube and the heating tube.

A particularly easy to operate embodiment for varying the effective heating length to the desired dwell time is achieved by the provision of a unitary heating tube which defines a plurality of partial tube lengths, and a tube heating system which is subdivided to correspond to the partial tube lengths, and which are independently adjustable. To this end, it is proposed to place several heating sleeves coaxially about the heating tube, and to connect each heating sleeve with a separate source of energy.

The several above described embodiments of the yarn heating apparatus of the present invention may be used in a melt spinning operation to provide a highly oriented yarn, and with the adjustability of the effective heating length providing a ready means for adapting the apparatus to different polymers and different processing speeds. More particularly, the melt spinning operation includes the steps of extruding a polymeric melt through a plurality of orifices of a spinning die so as to provide a plurality of separate filaments, withdrawing the filaments from the spinning die while cooling the same to a temperature below their solidification temperature to provide a bundle of advancing solidified filaments, applying a drawing force to the filaments in a drawing zone to impart a draw ratio of at least 1:2, and heating the advancing solidified filaments by guiding the same through a tubular heating tube. The resulting yarn is then wound onto a cross-wound package. In accordance with the present invention, the heating tube is positioned so that the initial drawing point (i.e. the upstream end of the drawing zone) is located within the tube, and the temperature and length of the tube are selected so as to achieve desirable physical properties in the resulting yarn.

BRIEF DESCRIPTION OF THE DRAWINGS

Some of the objects and advantages of the present invention having been stated, others will appear as the description proceeds, when taken in conjunction with the accompanying schematic drawings, in which.

DETAILED DESCRIPTION OF THE PREFERRED EMBODIMENTS

Figure 1:
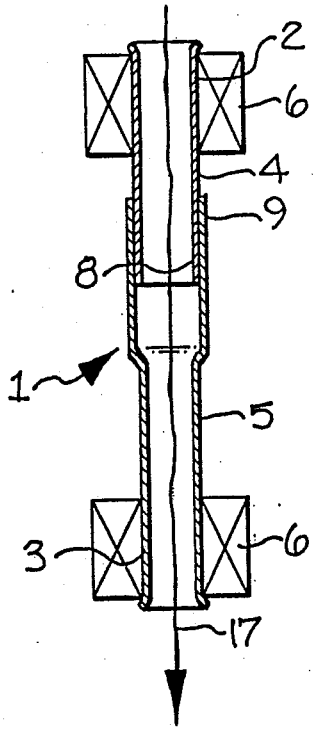
FIG. 1 illustrates an elongated heating tube in accordance with one embodiment of the present invention, and which comprises two tube sections which are telescopically interconnected.

Referring more particularly to the drawings, FIG. 1 illustrates a heating tube at 1 which represents a preferred embodiment of the present invention. The heating tube 1 comprises two coaxially aligned tube sections 4, 5, and with the sections having adjacent ends 8, 9 which are formed so that the sections may be telescopically interconnected. The tube sections also include outer ends 2 and 3, which define the yarn inlet end and the yarn outlet end of the heating tube. A heating sleeve 6 is positioned coaxially upon each tube section, so as to overlie each of the outer ends 2 and 3.

In a number of applications, it may be sufficient or appropriate to provide such a heating sleeve 6 only in the area 2 of the yarn inlet, or only in the area 3 of the yarn outlet. The telescopic interconnection, which is formed by the enlargement of the end 9 of the section 5, renders it possible to adapt the heating tube length, and thus the dwell time of the yarn 17 in the tube 1, to the pre-existing yarn properties, such as the specific polymer of which the yarn 17 is made, the total denier and the filament denier, the yarn speed, and the desired finished yarn properties with regard to strength, elongation behavior, shrinkage behavior, etc. In this regard, it does not especially matter whether the upper section 4 is inserted into the lower section 5, or vice versa.

Figure 2:
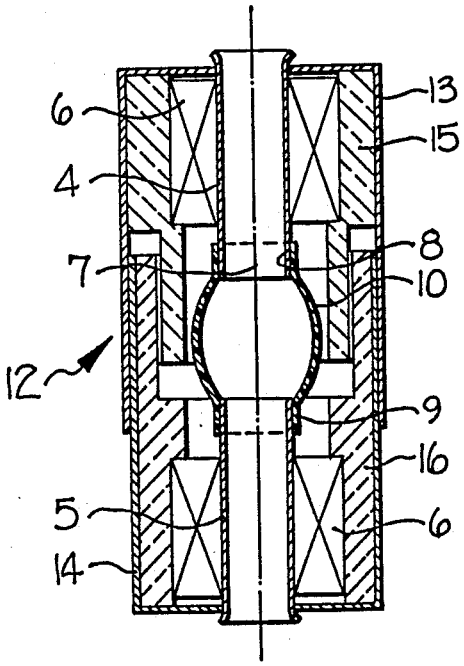
FIG. 2 shows a further embodiment of a heating tube in accordance with the present invention, and which includes a flexible coupler and insulating jacket connecting the two tube segments.

FIG. 2 illustrates an embodiment of the heating tube 1 of the present invention in which the two heating sections 4, 5 are interconnected by a flexible coupler 10 so as to be movable toward and away from each other along the common axis 7. The heating tube 1 is surrounded by an insulating jacket 12, which comprises a casing and lining mounted on each tube section. More particularly, the jacket 12 comprises an upper portion consisting of a casing 13 and lining 15, and a lower portion consisting of a casing 14 and lining 16, with the upper and lower portions being designed so that they overlap and may be moved axially toward and away from each other. More particularly, the adjacent ends of the linings 15, 16 and the adjacent ends of the casings 13, 14 are telescopically interconnected. In this manner, a good insulation of the heating tube 1 is achieved, so that if desired, one of the heating sleeves 6 may be omitted.

Figure 3:
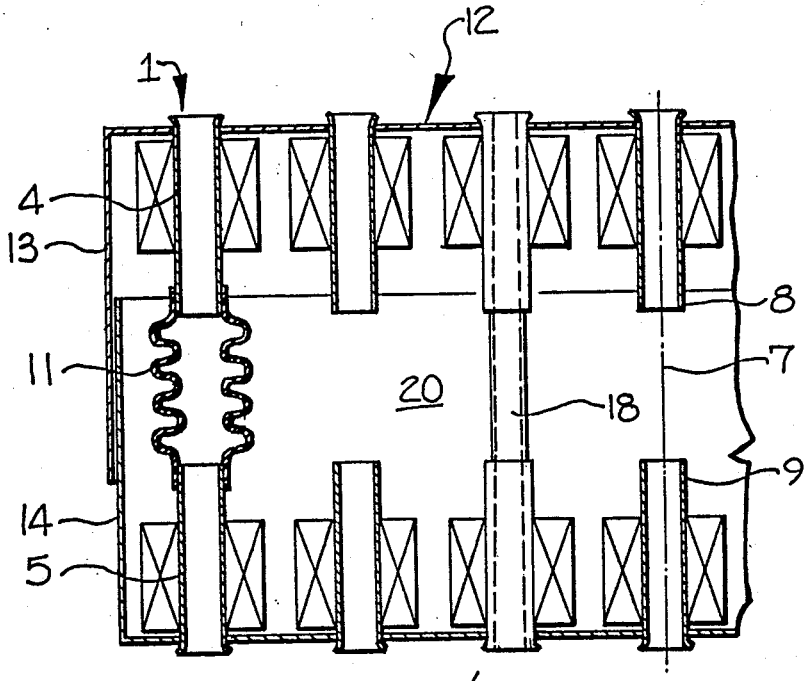
FIG. 3 illustrates an embodiment wherein a common insulating jacket mounts several heating tubes.

FIG. 3 shows an embodiment wherein several heating tubes 1 are arranged in a common insulating jacket 12. Such an arrangement may be useful for example when the tube 1, or also the interior 20 of the jacket 12, is to be heated by a hot gas, such as hot air, which circulates in the interior of the jacket. Also, in this embodiment the insulating jacket 12 comprises two parts, which do not include insulating linings, with the casings 13, 14 being telescopically interconnected. The two sections 4, 5 of the heating tube 1 may if desired be interconnected for example by a flexible bellows 11, or left unconnected, which is preferred when the interior of the jacket 12 is additionally heated.

Figure 4:
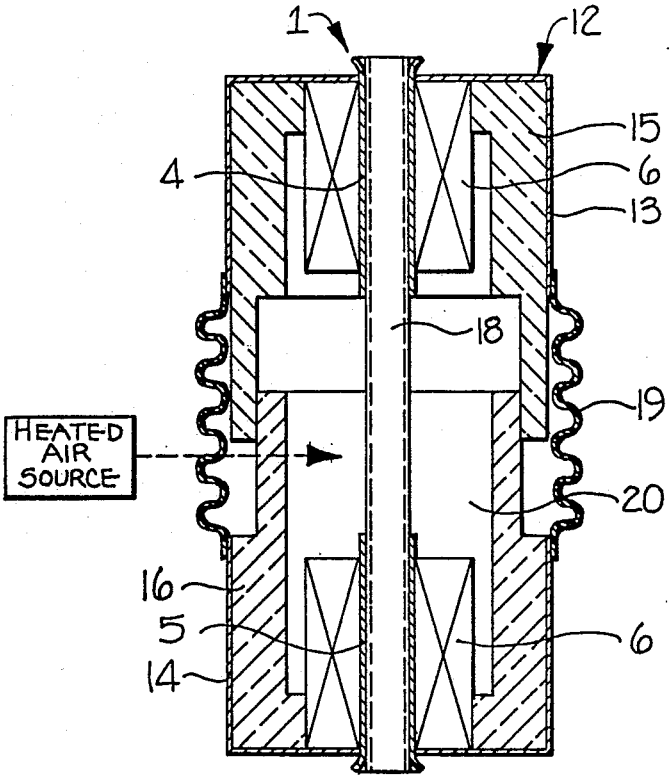
FIG. 4 illustrates an embodiment wherein the heating tube includes a guide tube extending between the two tube sections.

FIG. 4 illustrates another preferred embodiment of the heating tube of the present invention. In this embodiment, the tube comprises two sections 4, 5 having a guide tube 18 coaxially inserted so as to extend between the two sections 4, 5. The guide tube 18 is of a thin walled construction, and is preferably made of a material which can be readily cut by a simple tool, such as a knife, so that it can be adapted to the specific length of the heating tube. Also, the material of the guide tube 18 should be resistant to heat and have good sliding properties, and also good heat conductivity.

The heating tube 1 and the guide tube 18 are surrounded by an insulating jacket 12, which comprises a two-part casing 13, 14 and a similar two-part lining 15, 16. The two parts 13, 14 of the casing are interconnected by a bellows 19, whereas the lining parts 15, 16 are constructed similar to that of FIG. 2, i.e., with a telescopic interconnection. Also in this embodiment each section 4, 5 of the heating tube is heated by a separate heating sleeve 6, and in addition, the interior 20 of the jacket may be heated for example by circulating hot air. If desired, the heating tube 1 may be heated by only a single heating sleeve 6. Also, it should be understood that the guide tube 18 can be used in all of the embodiments of the heating tube of the present invention, note for example FIG. 3.

Figure 5:
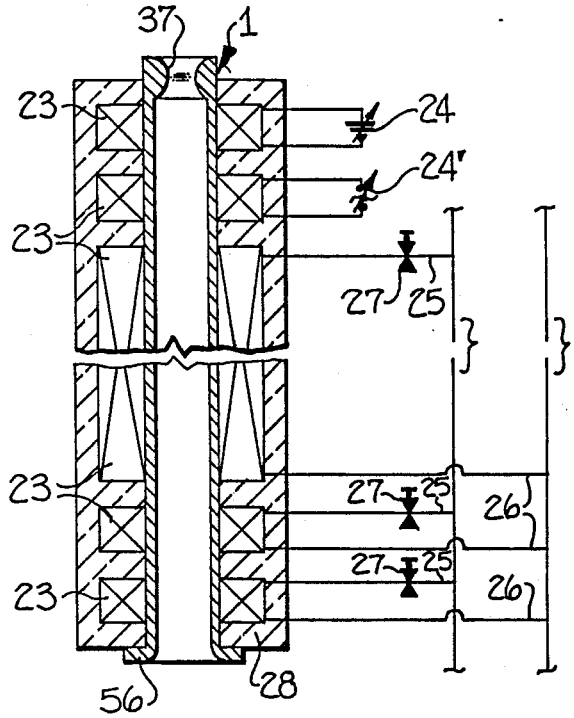
FIG. 5 shows an embodiment wherein a unitary heating tube defines a plurality of partial tube lengths, with the partial lengths being separately heated.

FIG. 5 represents an embodiment of the heating tube 1 wherein the heating tube comprises a unitary tubular metallic member which is divided into partial lengths by five separate heating sleeves 23. Two of the heating sleeves 23 at the upper and lower ends are shorter than the intermediate heating sleeve 23. All of the heating sleeves 23 entirely surround the heating tube 1. On its upper end, in the yarn inlet area, the heating tube 1 is provided with a yarn guide eyelet 37. At its yarn outlet end, the tube includes an outwardly extending radial flange 56. As a result, the outside diameter of the tube 1 is enlarged at its outlet end, and it remains uniform over its axial length. The heating sleeves 23 are supported by the radial flange 56, and may be pushed over the heating tube from above, and enclosed by a heat insulating material 28. The heat insulating material 28 also extends between the segments 23. Since the particular type of heating plays a subordinate role in achieving a variation of the effective heating length according to the invention, different types of heating systems are indicated for the different sleeves 23 in the drawing. More particularly, the two upper sleeves 23 are operated by an electrical resistance type heating system, and each of these sleeves is connected with a source of voltage which is controlled by a potentiometer. The uppermost sleeve 23 is, as illustrated, connected with a source of direct current 24, while the sleeve below is connected with a source of alternating current 24'. The intermediate heating sleeve 23 as well as the two lower sleeves 23 are supplied with heat from a fluid heating system. Each of these three lower heating sleeves 23 is provided with an individual supply line 25 and a return line 26 which form a part of the common heat circulation system. Interposed in each supply line 25 is a stop valve 27, which permits the heat supplied to the partial lengths of the tube to be independently controlled. The number of heating sleeves shown in FIG. 5 is merely representative, and serves only to illustrate one embodiment of the invention.

Figure 6:
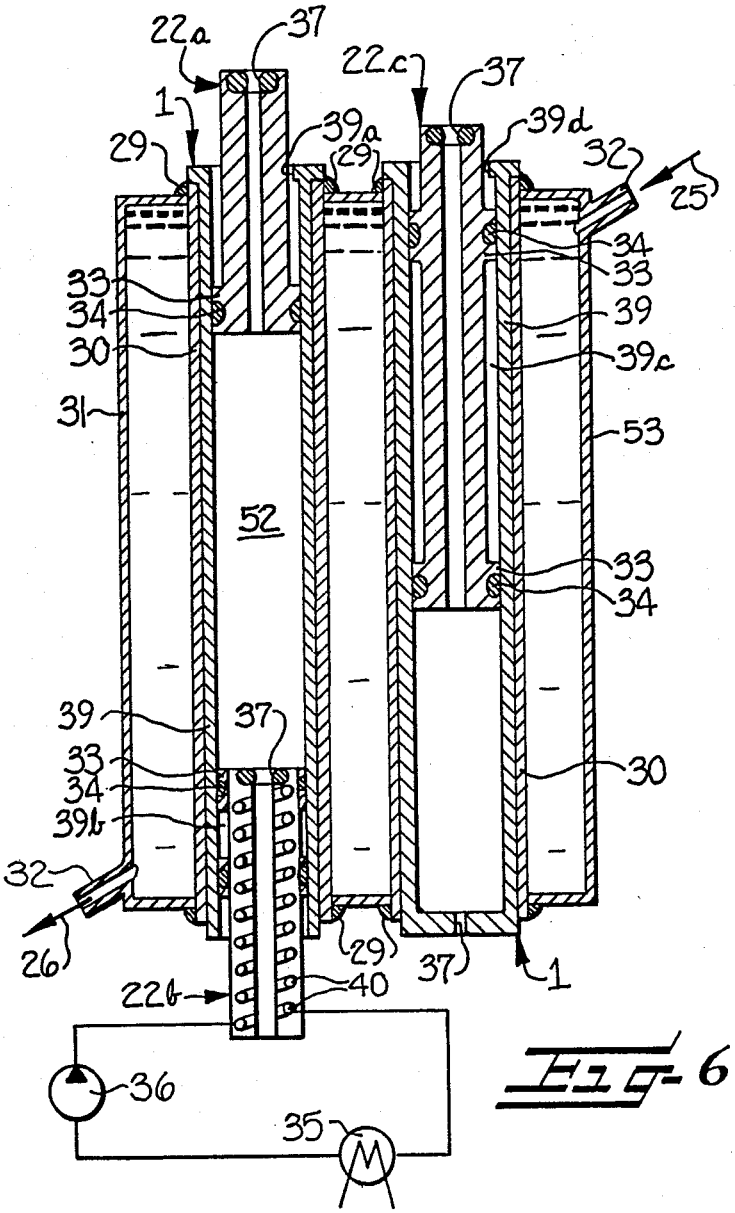
FIG. 6 illustrates an embodiment comprising a pair of heating tubes having insulating sleeves of different lengths positioned therein.

FIG. 6 illustrates an embodiment of the present invention wherein two heating tubes 1, which have different effective heating lengths, are mounted in a common heating box 31. The heating box 31 is rectangular in cross-section as illustrated, and may be formed of sheet metal. An inlet opening 32 is provided at its right upper corner as shown in FIG. 6, which connects to the supply 25 of the heating system. On its lower left corner is an outlet opening 32 which connects to the return line 26 of the heating system. Two vertically extending, continuous support tubes 30 are mounted in the box 31, and are welded to the box 31 on the outside as shown at 29, so that the support tubes 30 project somewhat beyond the surface of the box 31. The box 31 is filled with a fluid, which surrounds the support tubes 30 on all sides.

Two heating tubes 1 are coaxially inserted in the support tubes 30, and the heating tubes 1 have a flange at their upper ends which rests against the associated support tube 30. An insulating sleeve **22*a* is coaxially inserted into the left heating tube 1 from the top, and is held in place in the manner further described below. A second heating sleeve 22*b* is inserted into the left tube 1 from the bottom. Between the upper insulating sleeve 22*a* and the heating tube 1 is an air gap 39*a* which opens upwardly. Also, at its yarn inlet end, the upper insulating sleeve 22*a* is provided with a yarn guide eyelet 37, which is removably mounted in the insulating tube 22*a*** and thus serves as an easily exchangeable wear and tear part.

At the lower end of the upper insulating sleeve **22*a* is a circular flange 33 which accommodates a circular clamping ring 34. The flange 33 seals the interior 52 of the heating tube 1 in the upward direction. Also, the circular clamping ring 34 radially engages the bore of the heating tube 1 and thus secures the insulating sleeve 22*a*** in a selected position.

The lower insulating sleeve **22*b* includes a yarn guide eyelet 37 mounted at its inlet end, and two circular flanges 33 which are axially spaced apart so as to define an air gap 39*b* between the insulating sleeve 22*b* and the heating tube 1. A circular clamping ring 34 is positioned in each of the flanges 33, so as to secure the sleeve 22*b* in the heating tube 1. When viewed in the direction of the advancing yarn, the lower flange 33 forms another air gap which is open toward the outlet end of the tube 1. Also, a cooling coil 40 extends through the insulating sleeve 22*b* and is supplied with a coolant which is provided by a pump 36, which pumps the coolant through a cooler 35 and the sleeve 22*b*** in a closed system.

The heating tube 1 shown on the right hand side of the box 31 is identical in structure with the left hand heating tube 1. However, the insulating sleeve **22*c* which is inserted from the top, has a significantly longer insulating length. The two circular flanges 33 on the sleeve 22*c* form an enclosed air gap 39*c* and an additional upwardly open air gap 39*d*. A clamping ring 34 is inserted into each of the flanges 33, which support the sleeve 22*c* in the bore of the heating tube 1. In its yarn inlet area, the sleeve 22*c* mounts an exchangeable yarn guide eyelet 37, and in the outlet area of the tube 1, a further yarn guide eyelet 37 is fixedly mounted in the bore of the heating tube 1**.

Figure 6A:
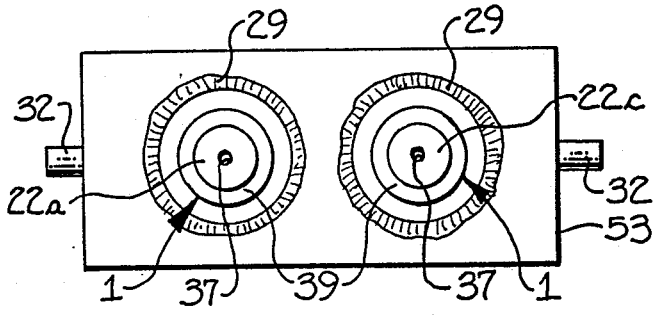
FIG. 6*a* is a top plan view of the embodiment of FIG. 6.

FIG. 6A is a top plan view of the heating system shown in FIG. 6. The arrangement of the two heating tubes 1 is symmetrical to each exterior side 53 of the box 31, and as illustrated, the welding seam 29 encircles each of the support tubes 30.

Figure 7:
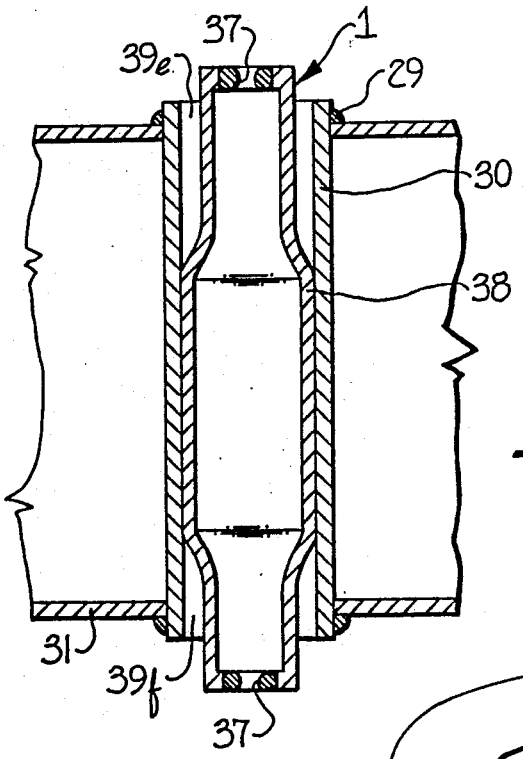
FIG. 7 is an embodiment comprising a heating tube which is supported by a support tube, with air gaps between selected portions of the support tube and heating tube.

FIG. 7 illustrates an embodiment of the present invention which includes a heating box 31 and an inserted heating tube 1. A support tube 30 is mounted in a vertically directed opening in the box 31, and is welded to the box at 29. The heating tube 1 is coaxially inserted into the support tube 30, and the heating tube 1 has a first cylindrical portion 38 which is sized to engage the bore of the support tube 30 and opposite end portions of a reduced diameter so as to be spaced from the bore of the support tube and so as to define air gaps **39*e*, 39*f* therebetween. These air gaps respectively open in the upward and downward directions. As illustrated, the upper air gap 39*e* is longer than the lower gap 39*f*, and has the same dimensions in the radial direction. A yarn guide eyelet 37** is mounted in the heating tube, both at its inlet end and its outlet end.

Figure 8:
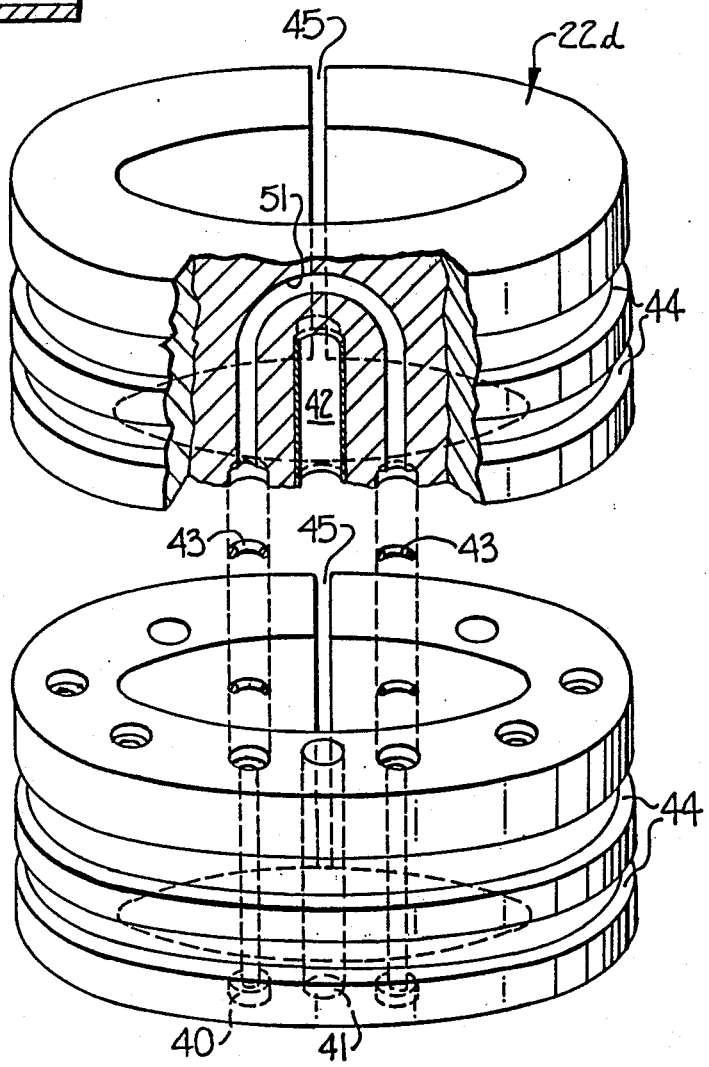
FIG. 8 is an exploded perspective view, partly broken away, showing one embodiment of an actively cooled insulating sleeve.

The following description relating to FIGS. 8–11 deals in greater detail with further embodiments of insulating sleeves, and which may be used in place of the insulating sleeves shown in FIG. 6. Referring initially to FIG. 8, there is disclosed an insulating sleeve **22*d*, which is transversely divided so as to form two parts, and with each part being slotted in the lengthwise direction at 45. The slots 45 permit the insulating sleeve 22*d* to be pressed together when it is in its operative position. Also, a pair of annular grooves 44 are provided on the periphery of each part, which are intended to form air gaps between the insulating sleeve and the heating tube. The lower part contains six axially extending cooling ducts 40 and such that the part may be combined with other parts having the same cross-section. As illustrated, the upper part includes a curved connecting passage 51, which interconnects with two adjacent ducts 40 in the lower part, and so that a through flow is provided. The two parts of the insulating sleeve 22*d* are held together by means of three axial threaded members which extend through an opening 41 in the lower part to engage a threaded bore 42 in the upper part. When interconnected in this manner, the interposed 0-rings 43 are compressed to seal the ducts 40, 51** between the two parts.

Figure 9:
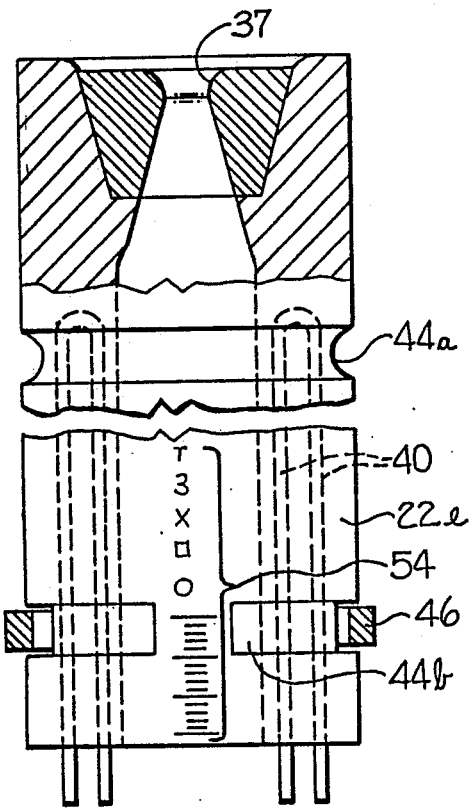
FIG. 9 is a partly sectioned view of another embodiment of an insulating sleeve.

FIG. 9 illustrates an insulating sleeve **22*e* which embodies the present invention, and which is provided with indicia 54 on its exterior. The indicia permit the extent to which the sleeve 22*e* is inserted in the heating tube 1 to be immediately determined. In addition, at its yarn inlet end, the insulating sleeve 22*e* includes a narrow passage or eyelet 37, which is made of a ceramic wear resistant material. The outside dimensions of the narrow eyelet are conical, so that it is easily exchangeable by simply being pushed into and out of the sleeve 22*e*. An annular groove 44*a* having a semicircular cross-section extends around the upper portion of the sleeve 22*e* with the intermediate portion of the insulating sleeve below the circular groove 44*a* not being shown in FIG. 9. The lower portion of the insulating sleeve 22*e* includes a groove 44*b* having a rectangular cross-section, which extends around a substantial portion of the periphery. A circular spring 46 is mounted in the groove 44*b*, with the outside diameter of the spring 46 being greater in its untensioned condition than that of the sleeve 22*e*. The circular spring 46 is thus compressed when the sleeve 22*e* is inserted in the heating tube 1, and serves to support the sleeve 22*e* in a selected position. The sleeve 22*e* is also provided with axially extending cooling ducts 40** to provide an active cooling of the sleeve.

Figure 10:
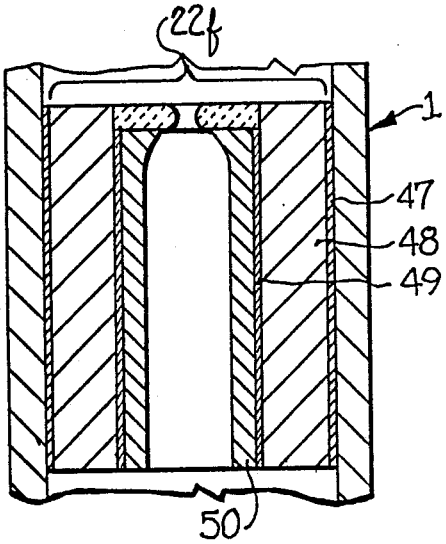

FIG. 10 shows an embodiment of an insulating sleeve in accordance with the present invention at 22*f*, and which is inserted into the heating tube 1. In this embodiment, the sleeve 22*f* comprises three layers. More particularly, there is provided an outer layer of an elastic, heat insulating material 47 which serves to removably mount the sleeve 22*f* in the bore of the heating tube 1, which is followed in the radial inward direction by a heat insulating layer 48. The third or inner layer comprises a more wear resistant yarn guide tube 50 which is cemented to the layer 48 by an adhesive 49.

Figure 11:
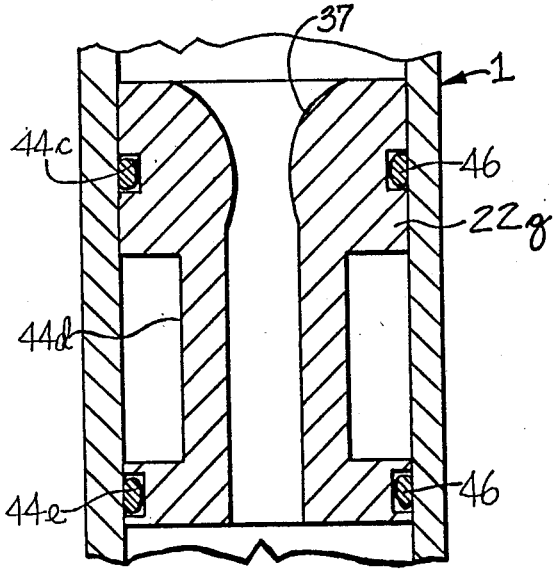
FIGS. 10 and 11 illustrate two further embodiments of an insulating sleeve positioned within the heating tube in accordance with the present invention.

FIG. 11 shows an insulating sleeve 22*g* which is inserted into a heating tube 1. The sleeve 22*g* includes a yarn guiding narrow passage or eyelet 37 at its upper end, which is integrally formed with the remainder of the sleeve 22*g*. Three circular grooves 44*c*, 44*d*, 44*e* are positioned on the periphery of the sleeve 22*g*, and the upper and lower grooves 44*c*, 44*e* each support a circular spring 46 which clamps the sleeve 22*g* against the bore of the heating tube 1. The middle groove 44*c* has substantially greater dimensions than the other two grooves, and it forms a closed insulating air gap with the bore of the heating tube 1.

While the illustrated embodiments of the heating tube 1 provide various means for effectively changing the heating length of the tube, it will be understood that other suitable combinations of the individually disclosed features are conceivable, which by reason of their diversity cannot all be shown.

Figure 12:
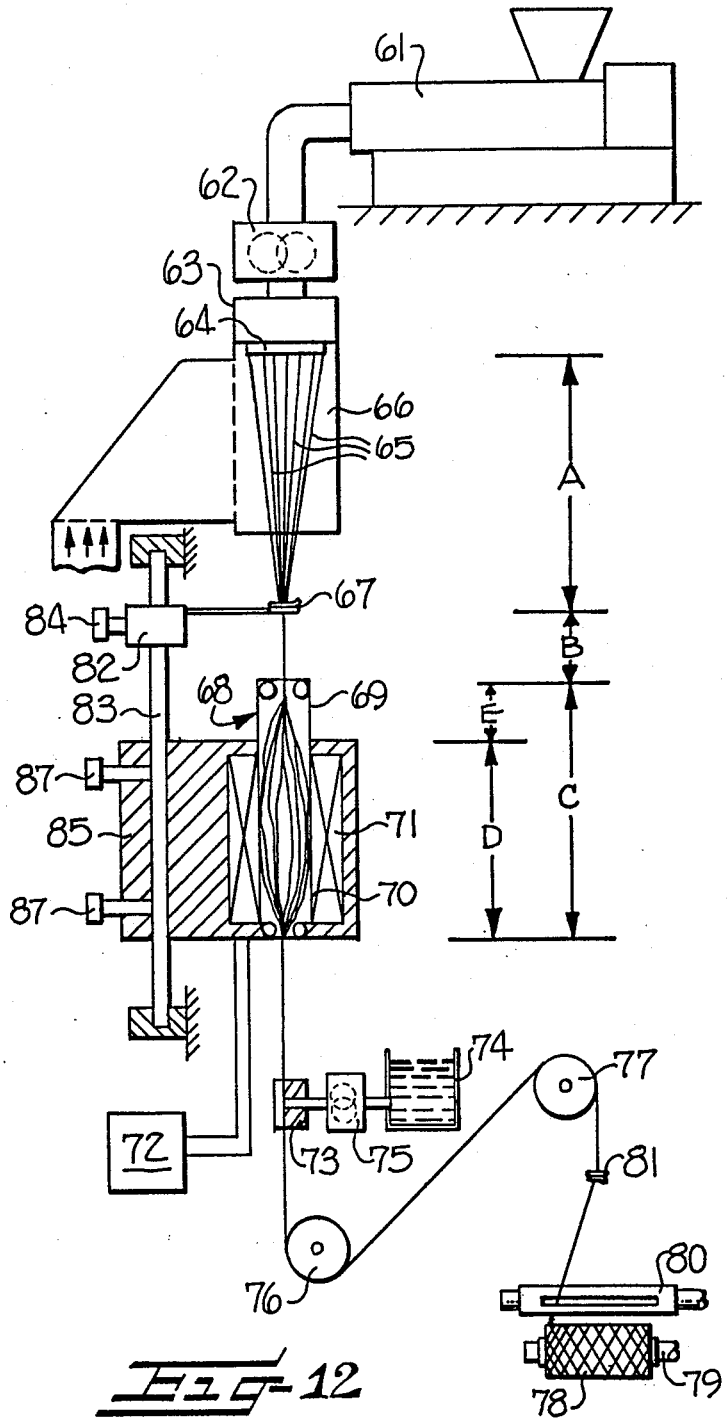
FIG. 12 is a schematic illustration of a melt spinning operation for producing a highly oriented yarn in accordance with the present invention.

Referring now to FIG. 12, there is illustrated a melt spinning process for producing a highly oriented yarn, and which embodies the features of the present invention.

As shown in FIG. 12, the spinning process comprises the following steps: a convenient polymer such as polyester, polyamide, polypropelene is melted and fed by extruder 61, gear pump 62, spinning head 63 and spinning die 64 through the nozzles of the spinning die. In the following description, the spinning of a polyethyleneterephtalate is specifically considered. The melt exits from the nozzles of the spinning die 64 in the form of a bundle 65 of single filaments. The bundle of filaments is then guided downwardly through a cooling shaft 66, where cold air is directed into contact with the bundle of filaments in order to cool it to a temperature, where the filaments are solidified. After leaving the cooling shaft 66, the bundle of filaments may be guided through a free air space at ambient temperature and to a thread guide 67 in the form of a narrow eyelet which serves to bring the filaments of the bundle together to form a compact yarn, and such that the filaments of the bundle between the die and the thread guide 67 have a diminishing distance between them.

From the thread guide the yarn is guided to the inlet eyelet of a heating tube 68. The inlet eyelet of the heating tube is made of ceramic and will produce an electrostatic charge on the filaments causing the filaments to balloon within the tube in an irregular movement. The entrance portion 69 of the tube 68 is unheated, and the lower part 70 of the tube 68 is heated by means of a conventional heater 71. The heater may, for example, be an electrical resistance heater or a box surrounding said tube and filled with a heated liquid or gas or vapor. Control means 72 is provided to heat the heater to an elevated temperature. The exit of tube 68 again has the form of a narrow eyelet, by which the filaments again are compacted into a yarn. The length C of the heating tube is preferably selected so as to be between 1.5 and 2.5 meters, and the bore diameter of the heating tube is preferably between 20 and 30 mm. The heating tube is usually heated to a temperature of between about 100° C. and 180° C.

The yarn exiting the tube is guided to a liquid applicator 73 which is fed with a spin finish 74 by means of a pump 75. The yarn is withdrawn by godets 76 and 77 which are partly wrapped by the yarn so that they can provide the needed drawing force on the yarn. Afterwards, the yarn is wound onto a cross-wound package 78 which is formed on a spindle 79 rotated at constant surface speed of the package 78. A traverse device 80 of known design, which is preceded by a thread guide 81, serves to guide the yarn back and forth along the length of the package so as to form a cross-wound package.

The thread guide 67 is fixed to a carrier 82 which is movable on a rod 83 installed on the spinning machine. The carrier 82 can be releasably attached to the rod 83 by means of the set screw 84. The tube 68 and heater 71 are mounted to a carrier 85, which is movable on the rod 83, with the carrier 85 being releasably attached to the rod 83 by means of set screws 87.

In the above apparatus, the godets 76 and 77 typically withdraw the resulting yarn at a speed of between about 4500 to 5400 m/min. This results in the filaments having an initial speed of typically about 50 m/min as they emerge from the die 64, and the speed increases in the cooling zone and reaches a speed of typically about 1700 m/min at the point at which the filaments have solidified. As the solidified filaments continue to advance, the speed is constant, and the resistance imparted by the ambient air causes the tensile force acting upon the filaments to continuously increase as the filaments move downwardly. When the tensile force reaches the elastic limit, drawing of the filaments commences. The point at which the drawing commences, and which is referred to herein as the initial drawing point, represents the upstream end of the drawing zone, and can be determined since the speed again increases after the initial drawing point. The downstream end of the drawing zone is defined by the godets 76 and 77. The draw ratio imparted to the filaments as they move through the drawing zone is typically 1:2, or greater.

In accordance with the present invention, the heating tube 68 is positioned so that the initial drawing point is located inside the tube, and preferably near the middle of the tube. This structural relationship is desirable, since the advancing solidified filaments should be initially heated to a predetermined temperature prior to the initial drawing point, and then heated for a predetermined time after drawing has commenced, in order to optimize certain of the physical properties of the resulting yarn, and particularly the shrinkage properties at boiling temperature. The initial heating of the solidified filaments preferably should be sufficient to reach the glass transition temperature, which is about 80°-90° C. in the case of polyester, prior to the drawing, and the heating after drawing has commenced is desirable to achieve useful physical properties, as noted above. Utilizing a heating tube having an adjustable length as described above with respect to FIGS. 1-11, provides assurance that the tube can be properly located with respect to the initial drawing point and that the proper temperature and duration of heating can be applied, for different polymers and different speeds.

With the above described spinning apparatus, it is possible to optimize the spinning process by adjusting the following spinning parameters:

(1) The extrusion rate of the molten filaments exiting the nozzles of die 64 which is in the range of 10 to 100 g/min, depending on the denier to be produced.

(2) The withdrawal speed measured at godet 76 and godet 77. The withdrawal speed in this invention is preferably higher than 4,500 m/min and not more than 5,400 m/min, and most preferably less than 5,300 m/min.

(3) The speed measured at the entrance of tube 68. This entering speed can be adjusted by adjusting the distance A between the die 64 and the thread guide 67, and the distance B between thread guide 67 and entrance of heating tube 68. Distance B in turn can be adjusted by adjusting the mounting of the heating tube 68 on the rod 83, and further by adjusting the length C of heating tube 68. The entering speed as per this invention should be adjusted to less than 1,700 m/min where the withdrawal speed is 4,500 m/min, and to less than 2,700 m/min where the withdrawal speed is 5,300 m/min. Corresponding entering speeds to withdrawal speeds between 4,500 and 5,300 m/min can be found by interpolation.

The winding speed measured at thread guide 81 is typically about 1% to 2% less than the withdrawal speed. The cooling temperature of the yarn is measured at thread guide 67 and may be as low as the ambient temperature, however, at least less than the glass transition temperature. The glass transition temperature varies depending on the kind of polymer to be spun and is typically between 80° and 90° C. for a polyethyleneterephtalate.

The heating temperature is above the glass transition point and may be as high as 140° C. for a tube having a length of between 180 and 220 cm and a diameter of 20 mm. Higher temperatures up to 200° C. are preferable for obtaining a yarn with lower shrinkage at boiling.

The object of the tests which are described below was to produce a yarn having a denier of 80 dtex and 30 filaments of polyethyleneterephtalate at a withdrawal speed of 5,000 m/min with a tenacity of more than 3 cN/dtx and an elongation at break of less than 30% and a shrinkage at boil of not more than 10%. In the tests, the distance A+B was adjusted to a total of between 2 and 3 meters. The heating tube length C was adjusted between 180 and 220 cm.

Negative results were obtained with A+B=2 and 3 m and C=1.80 m. The yarns obtained had an elongation at break between 50% and 60%.

Moderate results were obtained by the following adjustments: A+B=2 m and C=2.20 m. The produced yarn had an elongation at break which was in the range of 30%. The shrinkage, however, was very high and further steps had to be taken to bring it down.

Good results were obtained with A+B=more than 3 m and C=1.80 m. This yarn had an elongation at break of 30% and had a tenacity of 4.5 cN/dtex. The shrinkage was 8%. By increasing C, the shrinkage at boil could be reduced to less than 7%.

Measures to adjust the length of tube 68 designated by letter "C," and the heating length of tube 68 designated by letter "D" are described with respect to the above described embodiments of the heating tube as shown in FIGS. 1 to 11 of this application.

In the drawings and specification there has been set forth the best modes presently contemplated for the practice of the present invention, and although specific terms are employed, they are used in a generic and descriptive sense only and not for purposes of limitation, the scope of the invention being defined in the claims.

I claim:

1. A method for the melt spinning of a highly oriented yarn composed of a plurality of continuous filaments of a thermoplastic polymer or the like, and comprising the steps of extruding a polymeric melt through a plurality of orifices of a spinning die so as to provide a plurality of separate filaments, withdrawing the filaments emerging from the spinning die while cooling the withdrawn filaments in a cooling zone below said spinning die to a temperature below their solidification temperature to provide a bundle of advancing solidified filaments, advancing the solidified bundle from the cooling zone at a speed sufficient to apply a resistance force to the bundle from contact with the ambient air, applying a drawing force to the bundle of advancing solidified filaments and against said resistance force to effect drawing of the filaments in a drawing zone and so as to impart a draw ratio of at least 1:2 to the filaments and so as to produce a highly oriented resulting yarn, and with the drawing zone defining an initial drawing point at which the drawing commences, heating the bundle of advancing solidified filaments by guiding the same through a tubular heating tube, and including positioning the tube so that said initial drawing point is located within said tube, and selecting the temperature and length of the tube and positioning the heating tube so that the initial drawing point is located at a selected position within the length of the tube so as to achieve desirable physical properties in the resulting yarn, and winding the resulting yarn onto a cross-wound package.

2. The method as defined in claim 1 wherein the speed of the bundle of filaments at said initial drawing point is between about 1700 and 2700 m/min, and the speed leaving the drawing zone is between about 4500 and 5400 m/min.

3. The method as defined in claim 2 wherein the speed of the bundle of filaments at said initial drawing point is selected by interpolation to be not greater than 1700 m/min for a leaving speed of 4500 m/min, and not greater than 2700 m/min for a leaving speed of 5400 m/min.

4. The method as defined in claim 3 wherein the length of the heating tube is selected so as to be between 1.5 and 2.5 meters.

5. The method as defined in claim 3 wherein the heating tube has a bore diameter of between 20 and 30 mm.

6. The method as defined in claim 3 wherein said heating tube is heated to a temperature of between about 100° to 180° C.

7. The method as defined in claim 3 wherein the step of selecting the length of the heating tube includes adjusting the length of the tube while heating the entire length of the tube.

8. The method as defined in claim 3 wherein the step of selecting the length of the heating tube includes introducing an insulating sleeve into the bore of said heating tube, with the length of the insulating sleeve being less than the length of said heating tube, and selecting the overlap between the insulating sleeve and the heating tube so as to achieve a desired effective heating length.

9. The method as defined in claim 3 wherein the step of selecting the length of the tube includes positioning an insulating sleeve about the outside of the heating tube, with the length of the insulating sleeve being less than the length of said heating tube, and selecting the overlap between the insulating sleeve and the heating tube to achieve a desired effective heating length.

10. The method as defined in claim 1 wherein the step of applying a drawing force to the bundle of advancing solidified filaments includes withdrawing said bundle at a speed at least twice as high as the speed of the bundle advancing from said cooling zone.

11. The method as defined in claim 1 wherein said heating step includes initially heating the solidified filaments in said tube prior to reaching the initial drawing point and further heating the filaments in the tube after drawing has commenced.

* * * * *